US009748061B2

(12) United States Patent
Katzensteiner

(10) Patent No.: US 9,748,061 B2
(45) Date of Patent: Aug. 29, 2017

(54) SWITCHING DEVICE

(71) Applicant: EATON INDUSTRIES (AUSTRIA) GMBH, Schrems (AT)

(72) Inventor: Matthias Katzensteiner, Vienna (AT)

(73) Assignee: EATON INDUSTRIES (AUSTRIA) GMBH, Schrems (AT)

( * ) Notice: Subject to any disclaimer, the term of this patent is extended or adjusted under 35 U.S.C. 154(b) by 0 days.

(21) Appl. No.: 15/105,602

(22) PCT Filed: Dec. 18, 2014

(86) PCT No.: PCT/EP2014/078574

§ 371 (c)(1),
(2) Date: Aug. 11, 2016

(87) PCT Pub. No.: WO2015/091868

PCT Pub. Date: Jun. 25, 2015

(65) Prior Publication Data

US 2016/0372281 A1 Dec. 22, 2016

(30) Foreign Application Priority Data

Dec. 20, 2013 (DE) ..... 10 2013 114 663

(51) Int. Cl.
*H01H 33/10* (2006.01)
*H01H 33/38* (2006.01)
*H01H 71/24* (2006.01)

(52) U.S. Cl.
CPC ..... *H01H 33/38* (2013.01); *H01H 33/10* (2013.01); *H01H 71/24* (2013.01);
(Continued)

(58) Field of Classification Search
CPC ..... H01H 2009/0061; H01H 2201/008; H01H 2239/076; H01H 33/596; H01H 9/0027;
(Continued)

(56) References Cited

U.S. PATENT DOCUMENTS 3,914,720 A 10/1975 Drubig
4,325,041 A * 4/1982 Murai ..... H01H 71/04 335/16

(Continued)

FOREIGN PATENT DOCUMENTS

CN 101061559 A 10/2007
CN 101556883 A 10/2009

(Continued)

*Primary Examiner* — Truc Nguyen
(74) *Attorney, Agent, or Firm* — Leydig, Voit & Mayer, Ltd.

(57) ABSTRACT

A switching device has a first switching path having first switching contacts and has a second switching path having second switching contacts, wherein the first switching path has a first electromagnetic tripping apparatus having a first coil winding, wherein the first coil winding has a first winding direction, wherein the second switching path has a second electromagnetic tripping apparatus having a second coil winding, and wherein the second coil winding has a second winding direction. The first switching contacts and the second switching contacts are coupled for substantially simultaneous actuation. The first switching path and the second switching path are arranged adjacent to each other in the switching device. The first winding direction is opposite the second winding direction.

17 Claims, 3 Drawing Sheets

(52) U.S. Cl.
CPC .... *H01H 71/2409* (2013.01); *H01H 71/2463* (2013.01); *H01H 2071/249* (2013.01)

(58) Field of Classification Search
CPC .... H01H 9/0033; H01H 9/0038; H01H 9/542; H01H 9/548
See application file for complete search history.

(56) References Cited

U.S. PATENT DOCUMENTS 5,097,589 A * 3/1992 Rezac ..... H01H 71/0221 29/469
5,252,933 A * 10/1993 Kamino ..... H01H 89/08 335/172
5,541,561 A * 7/1996 Grunert ..... H01H 9/42 335/132
5,684,443 A 11/1997 Runyan et al.
5,892,420 A * 4/1999 Larranaga ..... H01H 71/125 335/18
6,600,399 B1 * 7/2003 Trandafir ..... H01F 7/066 335/222
2003/0067372 A1 * 4/2003 Funayama ..... H01H 50/026 335/128
2008/0055027 A1 * 3/2008 Kayama ..... G03B 9/10 335/222
2009/0219662 A1 9/2009 Mueller et al.
2010/0164658 A1 * 7/2010 Woo ..... H01H 71/40 335/21
2011/0260562 A1 * 10/2011 Bradfield ..... H01F 5/02 310/71
2012/0094840 A1 * 4/2012 Tanaka ..... H01F 6/04 505/211
2012/0326814 A1 * 12/2012 Ramirez ..... H01H 9/34 335/8
2014/0118097 A1 * 5/2014 Takahashi ..... H01H 50/12 335/202

FOREIGN PATENT DOCUMENTS

DE 492262 C 2/1930
DE 4330369 A1 3/1995
DE 10126852 A1 12/2002
EP 0570603 A1 11/1993
EP 2200065 A1 6/2010

* cited by examiner

SWITCHING DEVICE

CROSS-REFERENCE TO RELATED APPLICATIONS

This application is a U.S. national stage application under 35 U.S.C. §371 of International Application No. PCT/EP2014/078574, filed on Dec. 18, 2014, and claims benefit to German Patent Application No. DE 10 2013 114 663.5, filed on Dec. 20, 2013. The International Application was published in German on Jun. 25, 2015, as WO 2015/091868 A1 under PCT Article 21(2).

FIELD

The invention relates to a switchgear including switching contacts and coil windings.

BACKGROUND

Switchgear are known which, when certain predefined electrical states occur in a line leading through the switchgear, automatically open the switching contacts of the switchgear and interrupt the flow of current in the line in this way. Switchgear of this type is referred to as an automatic circuit breaker or circuit-protection device. In order to detect short circuits and to rapidly break a line in the event of a short circuit, electromagnetic tripping devices that comprise a coil in which an armature is movably arranged are known and standard. In the event of a short circuit, a magnetic field is generated in the coil which causes the armature to move, which in turn causes the switching contacts of the switchgear in question to open.

When interrupting a current, an arc is produced between the switching contacts that are being separated. This arc is very pronounced, particularly at high currents that prevail in the event of a short circuit. Circuit-protection devices therefore generally comprise an arc quenching apparatus. The circuit breaker is therefore generally shaped in the region of a contact point of the switching contacts such that an arc produced when the current is interrupted is, or is intended to be, guided or conveyed away from the contacts and into the arc quenching apparatus. Since an arc is an electrical conductor, a magnetic field has an effect on said arc. In known switchgear, particularly in the event of a short circuit being tripped, it has been shown that the arc may be negatively affected by magnetic fields in the switchgear, and said effect may be such that the arc is prevented from migrating from the switching contacts towards the arc quenching apparatus. As a result, the arc is not quenched, and therefore the flow of current through the switchgear is not interrupted either. In addition to a complete failure of the switchgear, this may also lead to injury to persons and damage to equipment.

SUMMARY

An aspect of the invention provides a switchgear, comprising: a first break gap including first switching contacts; and a second break gap including second switching contacts, wherein the first break gap includes a first electromagnetic tripping device including a first coil winding, wherein the first coil winding has a first winding direction, wherein the second break gap includes a second electromagnetic tripping device including a second coil winding, and wherein the second coil winding has a second winding direction. The first switching contacts and the second switching contacts are coupled so as to have substantially simultaneous actuation. The first break gap and the second break gap are arranged side by side in the switchgear. The first winding direction is opposite the second winding direction.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
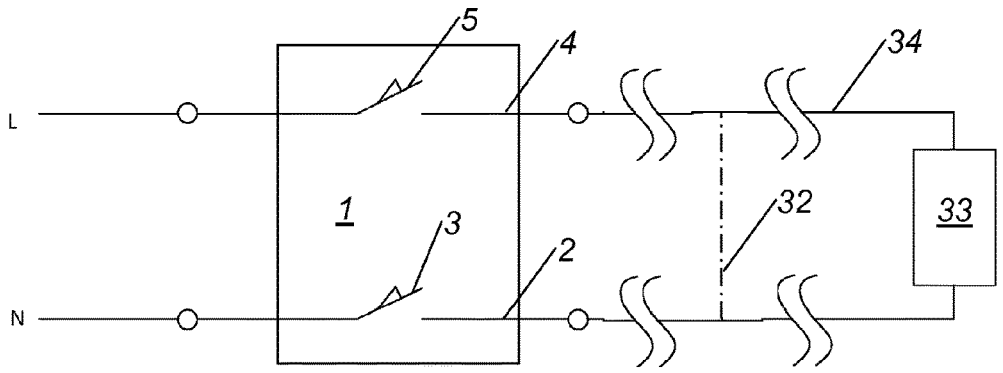
FIG. 1 is a circuit diagram of a typical circuit environment of a switchgear according to the invention.

An aspect of the invention provides a switchgear by means of which the above-mentioned drawbacks can be prevented, which has a long service life and low contact consumption, and by means of which, in the event of a short circuit, a defective circuit can be rapidly broken.

As a result, it can be ensured that the breaking arc migrates away from the contact point in the event of breaking due to tripping by means of one of the electromagnetic tripping devices. This means that contact consumption can be reduced, and the service life of the switchgear can be increased. As a result, particularly in the event of a short circuit, a defective circuit can be rapidly and reliably broken, by means of which not only is the service life of the switchgear itself increased, but also people and equipment can be better protected.

FIGS. 2 to 7 are either a schematic view or views of assemblies of a preferred embodiment of a switchgear 1 comprising a first break gap 2 which comprises first switching contacts 3 and comprising a second break gap 4 which comprises second switching contacts 5, the first break gap 2 comprising a first electromagnetic tripping device 6 which comprises a first coil winding 7, the first coil winding 7 having a first winding direction 8, the second break gap 4 comprising a second electromagnetic tripping device 9 which comprises a second coil winding 10, the second coil winding 10 having a second winding direction 11, the first switching contacts 3 and the second switching contacts 5 being coupled for substantially simultaneous actuation, and the first break gap 2 and the second break gap 4 being arranged side by side in the switchgear 1, wherein the first winding direction 8 is opposite the second winding direction 11.

As a result, it can be ensured that the breaking arc migrates away from the contact point in the event of breaking due to tripping by means of one of the electromagnetic tripping devices 6, 9, 20. This means that contact consumption can be reduced, and the service life of the switchgear 1 can be increased. As a result, particularly in the event of a short circuit, a defective circuit 34 can be rapidly and reliably broken, by means of which not only is the service life of the switchgear 1 itself increased, but also people and equipment can be better protected.

Figure 2:
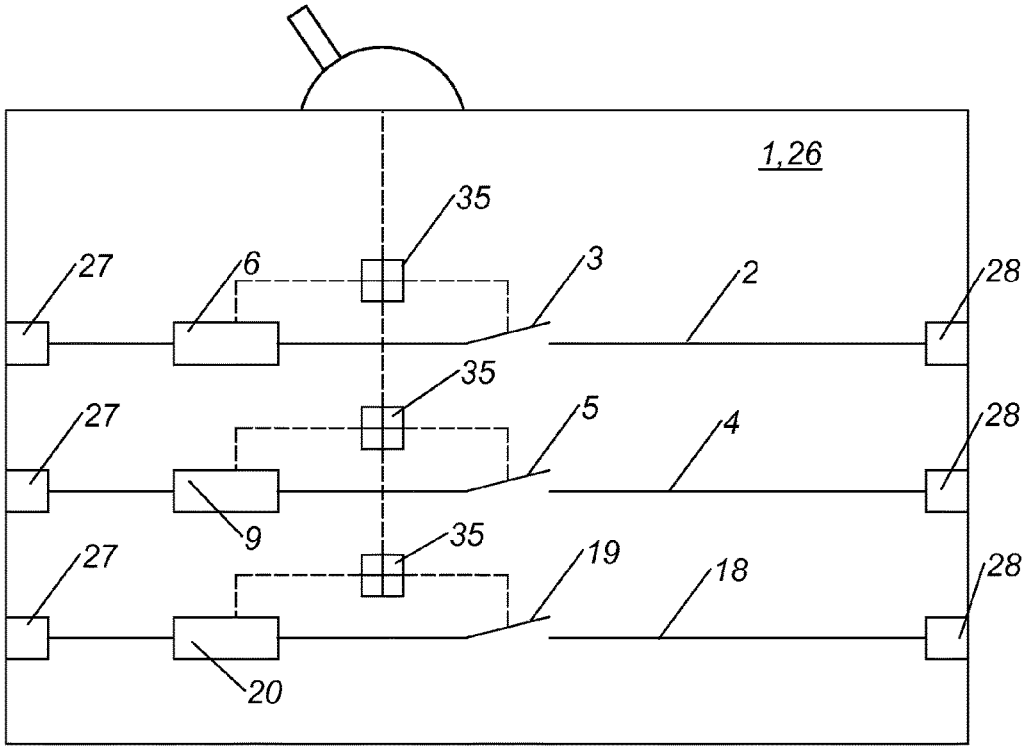
FIG. 2 is a schematic view of a switchgear according to the invention.
Figure 3:
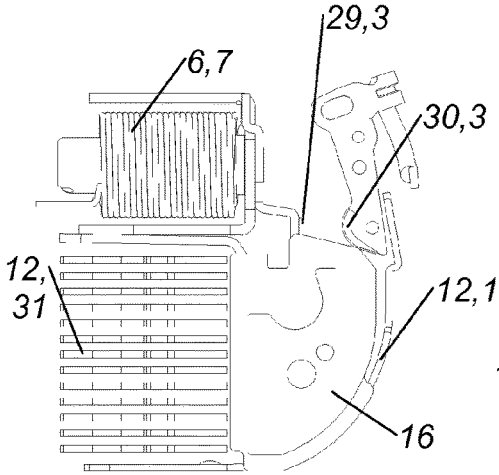
FIG. 3 is a side view of a preferred embodiment of an assembly made up of tripping devices, switching contacts and an arc quenching apparatus.
Figure 4:
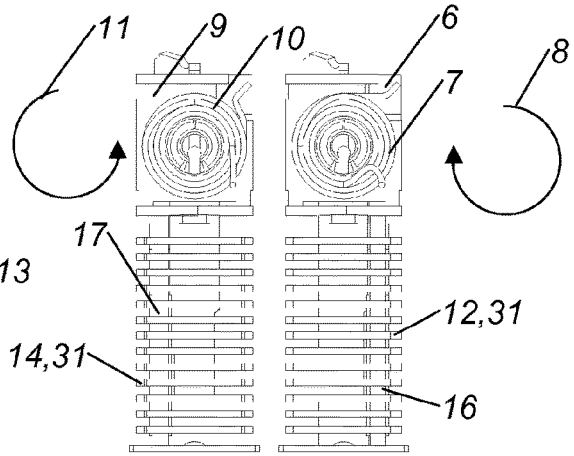
FIG. 4 is a front view of the arrangement according to FIG. 3.
Figure 5:
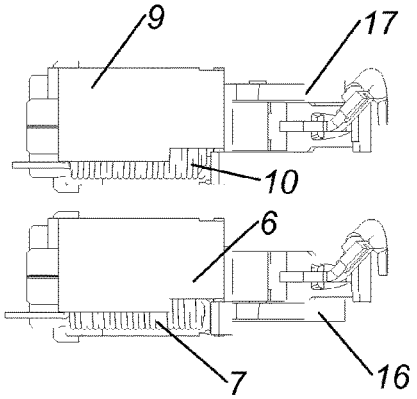
FIG. 5 is a plan view of the arrangement according to FIG. 3.
Figure 6:
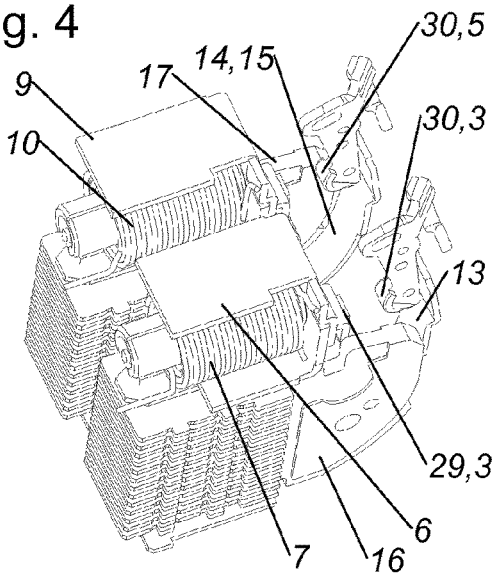
FIG. 6 is an axonometric view of the arrangement according to FIG. 3.

The switchgear 1 according to the invention comprises at least one first break gap 2 and one second break gap 4, it also being possible for a third break gap 18 to be provided according to the preferred embodiment shown schematically in FIG. 2. In addition, further break gaps may be provided.

In this case, a conductive connection or the current path through the switchgear 1, each of which leads from a first terminal 27 of the switchgear 1 to a second terminal 28 of the switchgear 1, is referred to as the break gap 2, 4, 18. In this case, the first and second terminals 27, 28 are provided with the same reference numeral in FIG. 2 for all the break gaps 2, 4, 18.

In the embodiments shown in FIGS. 3 to 6 having a first and a second break gap 2, 4, it is provided that an outer conductor of a mains network is connected to the first break gap 2, and that a neutral conductor of said mains network is connected to the second break gap 4. In the arrangement of three assemblies of a single switchgear 1 shown in FIG. 7, it is provided that three outer conductors of a mains network are connected to the three break gaps 2, 4, 18.

In each of the break gaps 2, 4, 18, switching contacts 3, 5, 19 are arranged which are each formed by at least one fixed contact 29 and one movable contact 30, it also being possible to provide multiple interruptions of the break gaps 2, 4, 18. First switching contacts 3 are arranged in the first break gap 2, second switching contacts 5 are arranged in the second break gap 4 and third switching contacts 19 are arranged in the optionally provided third break gap 18. In FIGS. 2 to 6 the respective fixed contacts 29 and the respective movable contacts 30 are each provided with the same reference numeral and additionally with the reference numeral of the respective break gaps 2, 4, 18 to which these are assigned.

The movable contacts 30 of the individual break gaps 2, 4, 18 are preferably each controlled by a latch 35. The first switching contacts 3, the second switching contacts 5 and possible additional switching contacts 19 are coupled for substantially simultaneous actuation, it being provided in particular that the latches 35 which are preferably provided in each case are coupled to one another.

In each of the break gaps 2, 4, 18, an electromagnetic tripping device 6, 9, 20 is arranged, i.e. a first tripping device 6, a second tripping device 9 and optionally a third tripping device 20. It is preferably provided that the first tripping device 6 and/or the second tripping device 9 and/or the third tripping device 20 is designed and arranged in the switchgear 1 such that, when a predetermined electrical state, in particular a short circuit, occurs in the first break gap 2 or the second break gap 4 or the third break gap 18, the switching contacts 3, 5, 19 are caused to open. The switchgear 1 according to the invention is therefore designed as an automatic circuit breaker, said switchgear in particular being designed as an automatic cut-out 26.

FIG. 1 shows a typical circuit environment of a switchgear 1 according to the invention comprising a load 33, the dashed line 32 representing a short circuit.

Each of the electromagnetic tripping devices 6, 9, 20 comprises a coil winding 7, 10, 21 or a coil body. A movable armature is arranged in each of the tripping devices 6, 9, 20 and, according to a preferred embodiment, drives a non-conducting tappet. The respective coil windings 7, 10, 21 are part of the respective current paths or break gaps 2, 4, 18, and the current flowing via the switchgear 1 flows through said respective coil windings. It may be provided that only one partial current flows through each of the coil windings 7, 10, 21. At a certain current level, the magnetic field generated by the coil winding 7, 10, 21 is sufficient to drive the armature and thus also the tappet that is preferably provided, which tappet moves out of the tripping device 6, 9, 20 and causes the switching contacts 3, 5, 19 to separate.

The individual break gaps 2, 4, 18 of the switchgear 1 are arranged side by side in the switchgear 1, and therefore the first break gap 2 and the second break gap 4 are arranged side by side, and if a third break gap 18 is provided, this is arranged in the switchgear 1 beside the second break gap 4.

It is preferably provided that the individual break gaps 2, 4, 18 are substantially identical except for the above-mentioned differences. The individual break gaps 2, 4, 18 therefore comprise the same structural units. Arranging the break gaps 2, 4, 18 side by side therefore preferably means that the identical assemblies of each of the individual break gaps 2, 4, 18 are arranged side by side in the housing of the switchgear 1. FIGS. 3 to 7 each show substantially identical assemblies of this type which are arranged side by side, even though the rest of the assemblies and the housing of the corresponding switchgear 1 are not shown.

It is preferably provided that the first coil winding 7 and the second coil winding 10 are arranged side by side so as to be substantially in parallel, and that a possibly additional third coil winding 21 is arranged substantially in parallel beside the second coil winding 10.

The coil windings 7, 10, 21 are each wound in a certain direction or according to a certain winding direction 8, 11, 22. This winding direction 8, 11, 22 can be referred to as being wound to the right or wound to the left, or as being clockwise or anticlockwise.

The first break gap 2 therefore comprises a first electromagnetic tripping device 6 comprising a first coil winding 7, which first coil winding 7 has a first winding direction 8. The second break gap 4 comprises a second electromagnetic tripping device 9 comprising a second coil winding 10, which second coil winding 10 has a second winding direction 11. If the switchgear 1 comprises a third break gap 18, the third break gap 18 comprises a third electromagnetic tripping device 20 comprising a third coil winding 21, which third coil winding 21 has a third winding direction 22.

It is provided that the first winding direction 8 is opposite the second winding direction 11. This can be clearly seen in FIGS. 4 and 6, for example. If there is a third coil winding 21 of a third break gap 18, it is provided that the third winding direction 22 is opposite the second winding direction 11. This can be clearly seen in FIG. 7, for example. The differing winding directions 8, 11, 22 of adjacent coil windings 7, 10, 21 may mean that the resulting magnetic field generated by the coil windings 7, 10, 21 themselves does not have a disadvantageous magnetic flow direction and high flow density in the region of the switching contacts 3, 5, 19, and in this way does not have a negative impact on the arc generated during a breaking procedure, i.e. when the switching contacts 3, 5, 19 open or separate, by said arc being kept between the switching contacts 3, 5, 19 by the magnetic effect of the tripping devices 6, 9, 20.

It is preferably provided that a first arc quenching apparatus 12 comprising a first arc path 13 is assigned to the first break gap 2, and that a second arc quenching apparatus 14 comprising a second arc path 15 is assigned to the second break gap 4. If a third break gap 18 is provided, it is more preferably provided that a third arc quenching apparatus 23 comprising a third arc path 24 is assigned to the third break gap 18.

The arc quenching apparatuses 12, 14, 23 more preferably each comprise a quenching plate assembly 31, which is shown in FIGS. 3 to 6. The arc paths 13, 15, 24 each represent the connection between the switching contacts 3, 5, 19 and the quenching plate assembly 31.

It is in particular provided that the first winding direction 8 and the second winding direction 11 are configured such that, in the event of a short circuit, the magnetic fields of the first and second tripping devices 6, 9 deflect or urge the arcs produced when the first and second switching contacts 3, 5 open towards the first and second arc quenching apparatuses 12, 14, or at least do not prevent said arcs from migrating in this direction. It is preferably provided that, in the event of a short circuit in the region of the contact points, the magnetic fields of the first and the second tripping devices 6, 9 each generate a Lorentz force acting in the direction of the arc quenching apparatuses 12, 14. The same applies to the preferred design of the switchgear 1 having three break gaps.

The magnetic effect of the coil windings 7, 10, 21 on a short-circuit breaking arc can be improved yet further by a first ferromagnetic plate 16 being arranged on just one side of the first arc path 13, and a second ferromagnetic plate 17 being arranged on just one side of the second arc path 15, and that, relative to the first arc path 13, the first ferromagnetic plate 16 is arranged on a different side from the second ferromagnetic plate 17 relative to the second arc path 15. Just one ferromagnetic plate 16, 17 is therefore assigned to each of the two arc paths 13, 15, and laterally delimits the arc path 13, 15 in question, it preferably being provided that the other side of the arc path 13, 15 is delimited by a plastics plate.

The ferromagnetic plates 16, 17, 25 are preferably surrounded on all sides by an insulating casing, and are in particular embedded or encapsulated in a plastics material.

The preferred side on which the ferromagnetic plates 16, 17, 25 in question are preferably arranged is linked to the winding direction 8, 11, 22 of the respective coil windings 7, 10, 21. It is preferably provided that the ferromagnetic plates 16, 17, 25 are arranged relative to the winding direction in accordance with what is shown in FIGS. 3 to 7, and are described in the following.

FIGS. 3 to 6 show a preferred embodiment of an assembly of two tripping devices 6, 9, two switching contacts 3, 5 and two arc quenching apparatuses 12, 14. In the viewing direction from the fixed contacts 29 to the movable contacts 30, the first winding direction 8 of the first coil winding 7 is to the right, and the first ferromagnetic plate 16 is arranged on the right-hand side of the first arc path 13 in precisely this viewing direction. The second winding direction 11 of the second coil winding 10 is to the left, and the second ferromagnetic plate 17 is arranged on the left-hand side of the second arc path 15.

Figure 7:
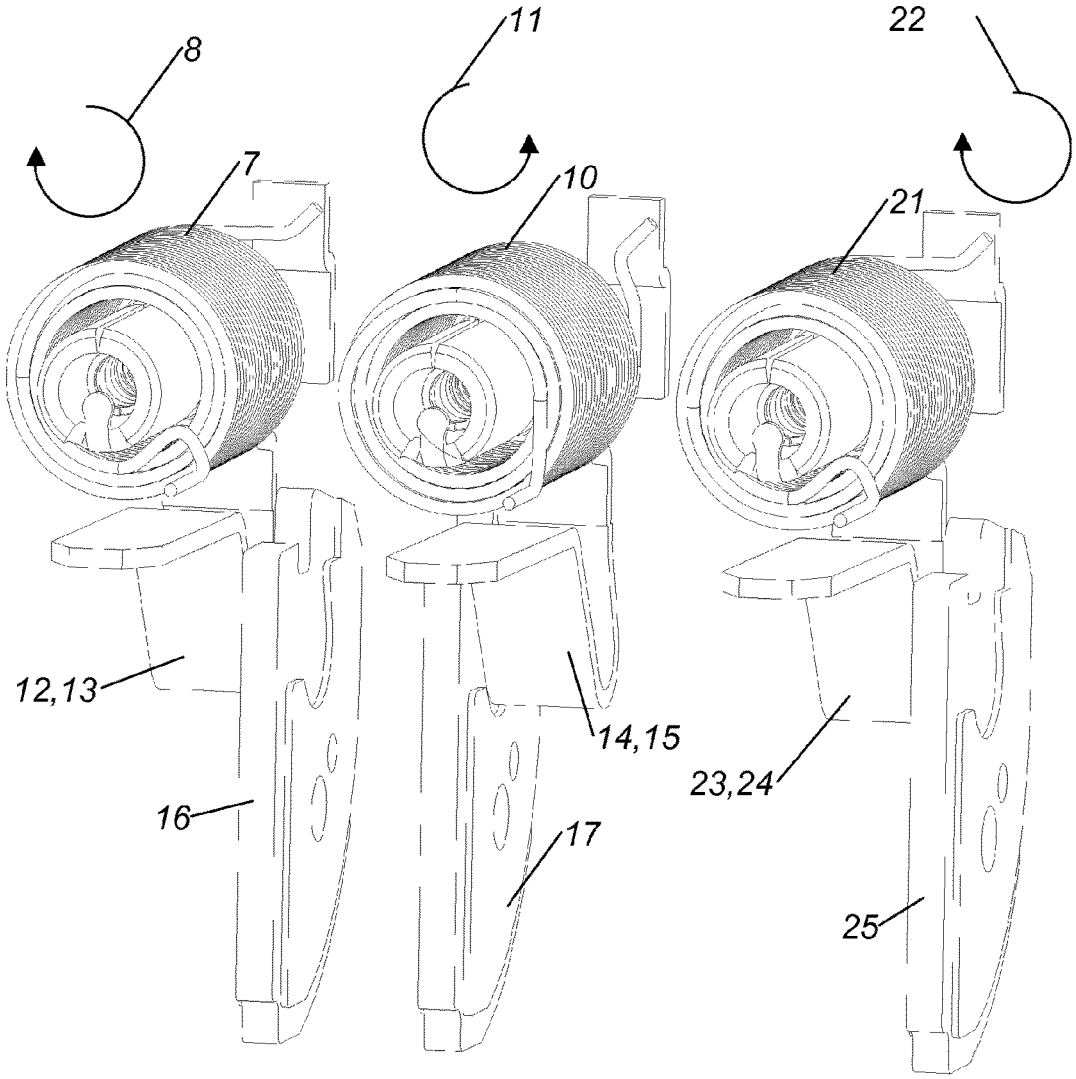
FIG. 7 shows the tripping devices and parts of the arc quenching apparatuses of a three-pole design of a switchgear according to the invention.

FIG. 7 shows the tripping device 6, 9, 20 and the parts, assigned to the fixed contacts 29, of the first, second and third arc paths 13, 15, 24 of a switchgear 1 comprising three break gaps 2, 4, 18. In this figure, the coil winding on the far left is referred to as the first coil winding 7, the first winding direction 8 of which is to the right in the viewing direction of the figure. The second winding direction 11 of the second coil winding 10 arranged therebeside is to the left, and the third winding direction 22 of the third coil winding 21 that is also shown beside the second coil winding 10 is then to the right. As shown in FIG. 7, the ferromagnetic plates are arranged alternately relative to the adjacent break gap 2, 4, 18, and therefore the third ferromagnetic plate 25, relative to the third arc path 24, which is only shown in part, is arranged on a different side from the second ferromagnetic plate 17 relative to the second arc path 15, which is also only shown in part.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

The invention claimed is:

1. A switchgear, comprising:

a first break gap including first switching contacts; and a second break gap including second switching contacts, wherein the first break gap includes a first electromagnetic tripping device including a first coil winding, wherein the first coil winding has a first winding direction, wherein the second break gap includes a second electromagnetic tripping device including a second coil winding, wherein the second coil winding has a second winding direction, wherein the first switching contacts and the second switching contacts are coupled so as to have substantially simultaneous actuation, wherein the first break gap and the second break gap are arranged side by side in the switchgear, wherein the first winding direction is opposite the second winding direction.

2. The switchgear of claim 1, wherein the first coil winding and the second coil winding are arranged side by side so as to be substantially in parallel with one another.

3. The switchgear of claim 1, wherein a first arc quenching apparatus including a first arc path is assigned to the first break gap, and wherein a second arc quenching apparatus including a second arc path is assigned to the second break gap.

4. The switchgear of claim 3, wherein a first ferromagnetic plate is arranged on just one side of the first arc path, wherein a second ferromagnetic plate is arranged on just one side of the second arc path, and wherein, relative to the first arc path, the first ferromagnetic plate is arranged on a different side from the second ferromagnetic plate relative to the second arc path.

5. The switchgear of claim 1, further comprising:

a third break gap including third switching contacts, wherein the third break gap includes a third electromagnetic tripping device including a third coil winding, wherein the third coil winding includes a third winding direction, wherein the third break gap is arranged beside the second break gap in the switchgear, wherein the third switching contacts is coupled to the first switching contacts and/or the second switching contacts for substantially simultaneous actuation, and wherein the third winding direction is opposite the second winding direction.

6. The switchgear of claim 5, wherein the third coil winding and the second coil winding are arranged side by side in the switchgear so as to be substantially in parallel with one another.

7. The switchgear of claim 5, wherein a third arc quenching apparatus including a third arc path is assigned to the third break gap, wherein a third ferromagnetic plate is arranged on just one side of the third arc path, and wherein, relative to the third arc path, the third ferromagnetic plate is arranged on a different side from the second ferromagnetic plate relative to the second arc path.

8. The switchgear of claim 5, wherein the first tripping device and/or the second tripping device and/or the third tripping device is configured such that, when a predetermined electrical state occurs in the first break gap or the second break gap or the third break gap, the switching contacts open.

9. The switchgear of claim 1, wherein the switchgear (1) is designed as an automatic cut-out (26).

10. The switchgear of claim 2, wherein a first arc quenching apparatus including a first are path is assigned to the first break gap, and wherein a second arc quenching apparatus including a second are path is assigned to the second break gap.

11. The switchgear of claim 5, wherein the third switching contacts is coupled to the first switching contacts.

12. The switchgear of claim 5, wherein the third switching contacts is coupled to the second switching contacts.

13. The switchgear of claim 5, wherein the third switching contacts is coupled to the first switching contacts and the second switching contacts.

14. The switchgear of claim 6, wherein a third arc quenching apparatus including a third arc path is assigned to the third break gap, wherein a third ferromagnetic plate is arranged on just one side of the third arc path, and wherein, relative to the third arc path, the third ferromagnetic plate is arranged on a different side from the second ferromagnetic plate relative to the second arc path.

15. The switchgear of claim 8, wherein the predetermined electrical state is a short circuit.

16. The switchgear of claim 1, wherein the first tripping device and/or the second tripping device is configured such that, when a predetermined electrical state occurs in the first break gap or the second break gap, the switching contacts open.

17. The switchgear of claim 16, wherein the predetermined electrical state is a short circuit.

* * * * *